US010179880B2

(12) United States Patent
O'Rear et al.

(10) Patent No.: US 10,179,880 B2
(45) Date of Patent: Jan. 15, 2019

(54) PROCESS, METHOD, AND SYSTEM FOR REMOVING HEAVY METALS FROM FLUIDS

(71) Applicant: Chevron U.S.A. Inc., San Ramon, CA (US)

(72) Inventors: Dennis John O'Rear, Petaluma, CA (US); Russell Evan Cooper, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 81 days.

(21) Appl. No.: 14/922,383

(22) Filed: Oct. 26, 2015

(65) Prior Publication Data

US 2016/0122658 A1 May 5, 2016

Related U.S. Application Data

(60) Provisional application No. 62/149,751, filed on Apr. 20, 2015, provisional application No. 62/073,445, filed on Oct. 31, 2014.

(51) Int. Cl.

| | |
|---|---|
| ***C07C 7/148*** | (2006.01) |
| ***C10G 31/06*** | (2006.01) |
| ***C10G 7/00*** | (2006.01) |

(52) U.S. Cl.

CPC ..... *C10G 31/06* (2013.01); *C10G 7/00* (2013.01)

(58) Field of Classification Search

CPC ..... C07C 7/148; C10G 31/06

See application file for complete search history.

(56) References Cited

U.S. PATENT DOCUMENTS

| | | | | |
|---|---|---|---|---|
| 5,062,948 | A * | 11/1991 | Kawazoe | C10G 25/00 208/187 |
| 5,107,060 | A * | 4/1992 | Yan | C10G 55/04 208/251 R |
| 5,202,301 | A | 4/1993 | Mc. Namara | |
| 5,336,835 | A | 8/1994 | Mc. Namara | |
| 5,384,040 | A * | 1/1995 | Mank | C10G 53/08 208/251 H |
| 8,728,304 | B2 | 5/2014 | Gallup et al. | |
| 2010/0025184 | A1* | 2/2010 | Shibuya | C10G 31/00 196/46 |
| 2010/0051553 | A1 | 3/2010 | Walterick, Jr. et al. | |
| 2013/0225897 | A1* | 8/2013 | Candelon | C07C 7/148 585/802 |

* cited by examiner

*Primary Examiner* — Randy Boyer

(74) *Attorney, Agent, or Firm* — Karen R. DiDomenicis; Howard V. Owens

(57) ABSTRACT

Particulate mercury, in the form of metacinnabar, is removed from crude oil by thermally treating the crude oil at temperatures in a range from 150° C. to 350° C. and at a pressure sufficient to limit the amount of crude vaporizing to no more than 10 wt. %. In the thermal treatment, the particulate mercury is converted into elemental mercury, which can be removed by directly adsorption from the crude onto a support. In one embodiment, the elemental mercury can be removed by stripping the crude with a gas, and then adsorbing the mercury onto a support. The crude oil can be optionally treated prior to stabilization and contains 0.1 wt. % or more of $C_4$-hydrocarbons. Following the thermal treatment, the treated crude is cooled and the pressure is reduced. The $C_4$-hydrocarbons then vaporize from the crude and carry the elemental mercury with them. The elemental mercury in this hydrocarbon gas stream may then be removed by a solid adsorbent.

2 Claims, 3 Drawing Sheets

PROCESS, METHOD, AND SYSTEM FOR REMOVING HEAVY METALS FROM FLUIDS

TECHNICAL FIELD

The invention relates generally to a process, method, system, and management plan for removal and control of heavy metals such as mercury from fluids.

BACKGROUND

Heavy metals such as mercury can be present in trace amounts in hydrocarbon gases, crude oils, and produced water. The amount can range from below the analytical detection limit to several thousand ppbw (parts per billion by weight) depending on the source. Crudes containing 50 ppbw total mercury or more are referred here as high mercury crudes. When processed in a refinery, the mercury in high mercury crudes accumulates in the distillation products. In addition, liquid elemental mercury may accumulate in some equipment. If mercury is removed from crude oil, a mercury-containing waste product is generated, or the mercury is recovered as a valuable byproduct. In order to minimize the volume and cost of disposal of this waste mercury, it is desired that the waste have as high a mercury content as possible. In addition the mercury in the waste should be essentially non-leachable and pass TCLP (Toxicity characteristic leaching procedure) requirements.

There are processes in the prior art to remove mercury in crude oils. But these generate either a gaseous mercury-containing waste product, an aqueous mercury-containing waste product, or a dilute solid waste product that contains less than about 100 ppmw Hg and is therefore produced in large volumes. Various methods to remove trace metal contaminants in liquid hydrocarbon feed such as mercury have been disclosed, including the removal of mercury from water by iodide impregnated granular activated carbons. U.S. Pat. No. 5,336,835 discloses the removal of mercury from liquid hydrocarbon using an adsorbent comprising an activated carbon impregnated with a reactant metal halide, with the halide being selected from the group consisting of I, Br and Cl. U.S. Pat. No. 5,202,301 discloses removing mercury from liquid hydrocarbon with an activated carbon adsorbent impregnated with a composition containing metal halide or other reducing halide. US Patent Publication No. 2010/0051553 discloses the removal of mercury from liquid streams such as non-aqueous liquid hydrocarbonaceous streams upon contact with a Hg-complexing agent for mercury to form insoluble complexes for subsequent removal. U.S. Pat. No. 8,728,304 describes the removal of trace element levels of heavy metals such as mercury in crude oil by contacting the crude oil with an iodine source, generating a water soluble heavy metal complex for subsequent removal from the crude oil.

Particulate mercury in crudes presents a challenge to the removal of mercury from crude oil as particulate is more difficult to remove than elemental mercury. While some particulate can be removed by filtration, filtration may not be effective in removing particulate mercury when substantial amounts are present in particles below 0.45 μm (microns).

Adsorption technology does not work well for crude oils and condensates with low levels of mercury, and particularly crude oils containing the non-volatile form of mercury, which has not been well addressed in the prior art. There is a need for improved methods for the removal of mercury from liquid hydrocarbon streams, especially the non-volatile particulate form of mercury.

What is needed is a process to remove mercury from crudes and condensates that does not generate gaseous or liquid mercury-containing waste products; which removes particulate mercury, especially fine particulate mercury present in particles below 0.45 μm; which produces a concentrated solid waste product containing more than 100 ppmw Hg; and which also removes elemental mercury in the crude oil or in a gas that is in contact with the crude oil.

There is a need for an improved method to manage, control, and remove mercury in produced fluids from a reservoir, e.g., gas, crude, condensate, and produced water.

SUMMARY

In one aspect, the invention relates to a method for converting particulate mercury in a crude oil by thermal decomposition. The crude oil may contain 0.1 wt. % or more of C4-hydrocarbons. Further, at least 10 wt. % of the mercury containing in the crude oil is present in particulate form. The invention further relates, in one aspect, to a method for stabilizing a crude oil feed. The stabilization method may involve a step of removing mercury from an unstable crude oil. Thus, the invention relates to a method for removing mercury from a mercury-containing crude oil feed in which greater than 10 wt. % of the mercury contained therein is particulate mercury, the crude oil feed containing C4-hydrocarbons, the method comprising: heating the crude oil feed to a first temperature in a range from 150° C. to 350° C. and at a first pressure to retain at least 90 vol. % of the C4-hydrocarbons in the liquid phase crude oil; maintaining the heated crude oil at the first temperature and at the first pressure for 0.1 hours to 10 hours, to convert particulate mercury in the crude oil to elemental mercury (Hg0); cooling the heated crude oil to a second temperature in a range from 40° C. to 150° C.; reducing the pressure of the cooled crude oil to a second pressure lower than the first pressure, and maintaining the cooled crude oil at the second temperature and at the second pressure for 0.1 hours and 10 hours to vaporize at least a portion of the C4-hydrocarbons and at least a portion of the elemental mercury contained in the crude oil; and recovering a stabilized crude oil containing a reduced amount of C4-hydrocarbons and at least 10 wt. % less mercury than is contained in the crude oil feed.

In one respect, the method includes a partially stabilizing a crude oil prior to the mercury removal process. Thus, a method is provided for removing mercury from a mercury-containing crude oil feed in which greater than 10 wt. % of the mercury contained therein is particulate mercury, the crude oil feed containing 0.1 wt. % or more of C4-hydrocarbons, the method comprising: degassing the crude oil feed by removing C4-hydrocarbons contained therein, to produce a partially stabilized crude oil having a true vapor pressure in a range of between greater than 9 psig and less than or equal 14 psig, and a first C4-hydrocarbon enriched gaseous stream; heating the partially stabilized crude oil to a first temperature in a range from 150° C. to 350° C. and at a first pressure, to retain at least 90 vol. % of the C4-hydrocarbons in the liquid phase crude oil; maintaining the heated partially stabilized crude oil at the first temperature and at the first pressure for 0.1 hours to 10 hours, to convert particulate mercury in the crude oil to elemental mercury; cooling the heated partially stabilized crude oil to a second temperature in a range from 40° C. to 150° C.; reducing the pressure of the cooled partially stabilized crude oil to a second pressure lower than the first pressure, and maintaining the cooled partially stabilized crude oil at the second temperature and at the second pressure for 0.1 hours and 10 hours to produce a second C4-hydrocarbon enriched gaseous stream that contains at least a portion of the elemental mercury from the crude oil; and recovering a stabilized crude oil containing a reduced amount of C4-hydrocarbons and at least 10% less mercury than is contained in the crude oil feed.

In another aspect, the invention relates to removing mercury from crude oil using a mercury reactive adsorbent. Thus, a method is provided for removing mercury from a mercury-containing crude oil feed in which greater than 10 wt. % of the mercury contained therein is particulate mercury, the method comprising: heating the crude oil feed at a first temperature to convert particulate mercury in the crude oil to elemental mercury (Hg0) and at a first pressure above a bubble point pressure of the crude oil for a time sufficient to convert particulate mercury in the crude oil to elemental mercury; cooling the crude oil and contacting the cooled crude oil with a mercury removal adsorbent to adsorb elemental mercury from the cooled crude oil; recovering a mercury-reduced crude oil that contains an amount of mercury that is at least 10 vol. % lower than the mercury content of the crude oil feed.

DETAILED DESCRIPTION

Figure 1:
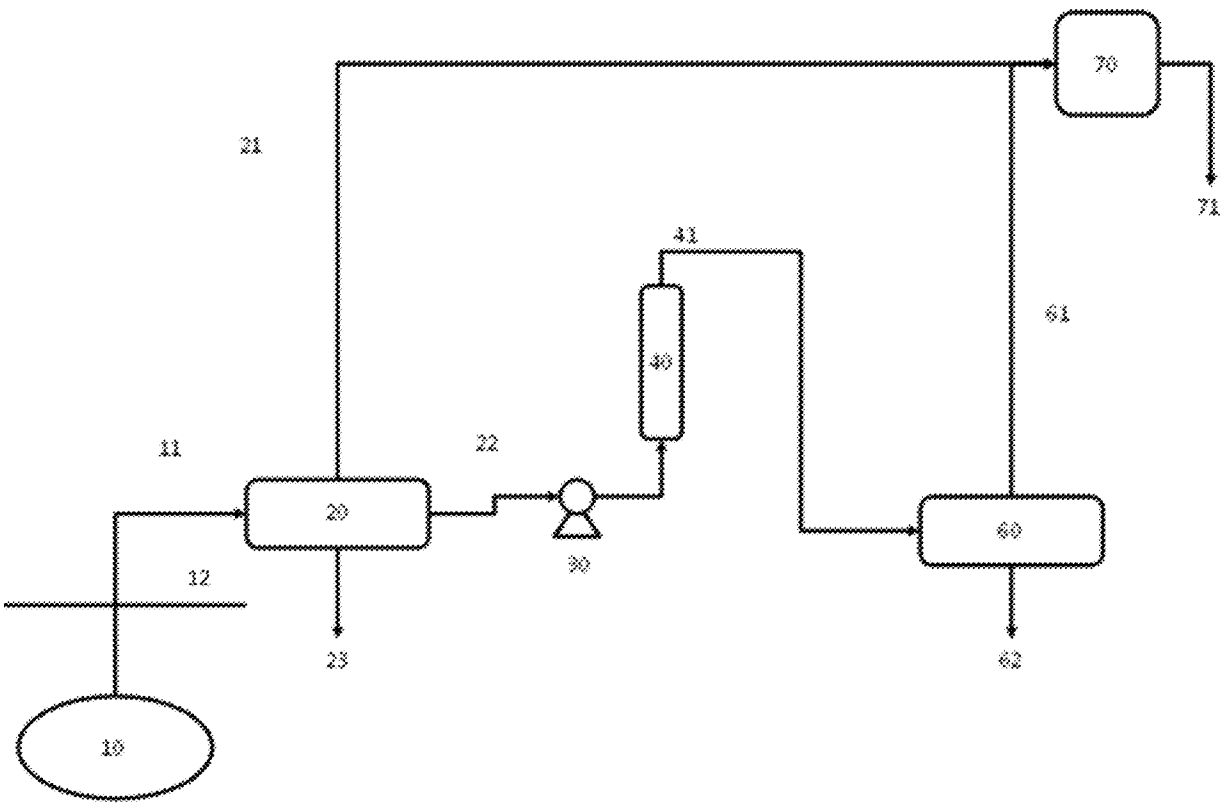
FIG. 1 illustrates an embodiment of the process, having a thermal decomposition reactor for converting mercury in crude oil to elemental mercury, and a treater degasser that produced a stabilized crude oil.

The following terms will be used throughout the specification and will have the following meanings unless otherwise indicated.

"Hydrocarbon" refers to a pure compound or mixtures of compounds containing hydrogen and carbon and optionally sulfur, nitrogen, oxygen, and other elements. The term "crude oil" refers to a liquid hydrocarbon material produced from a subterranean geological formation, which may optionally be dewatered and/or degassed following production. "Crude", "crude oil", "crudes" and "crude blends" are used interchangeably and each is intended to include both a single crude and blends of crudes. As used herein, the term crude oil may also refer to a light petroleum product termed a "condensate" that is typically associated with natural gas production for a subterranean formation. While condensate can leave the reservoir either as a liquid or as a gas, it is processed as a liquid. Other exemplary crude oils that may be treated in the process include synthetic crude oils such as shale oils, biomass pyrolysis products, etc.

"High mercury crude oil" refers to a crude oil or condensate containing 50 ppbw or more of total mercury. Exemplary high mercury crude oil contains 100 ppbw or more of total mercury; or 250 ppbw or more of total mercury, or 1000 ppbw or more of total mercury.

"Total Mercury" is the sum of all mercury species and phases present in a sample. It is measured by Lumex or other appropriate alternative method for crudes having more than 50 ppbw mercury. If an alternative method does not agree with a Lumex measurement, the Lumex measurement is used. For crudes having less than 50 ppbw mercury, the total mercury is measured by CEBAM analysis or other appropriate alternative method. If an alternative method does not agree with a CEBAM measurement, the CEBAM measurement is used.

"Particulate Mercury" refers to mercury that can be removed by filtration or centrifugation. Solid metacinnabar and cinnabar are examples of species which contribute to particulate mercury. For purposes of this disclosure, elemental mercury is not included in "particulate mercury".

"Percent Particulate Mercury" refers to the portion of mercury that can be removed from the crude oil by centrifugation or filtration. After the centrifugation the sample for mercury analysis is obtained from the middle of the hydrocarbon layer. The sample is not taken from sediment, water or rag layers. The sample is not shaken or stirred after centrifugation. In one embodiment, percent particulate mercury is measured by filtration using a 0.45 micron filter or by using a modified sediment and water (BS&W) technique described in ASTM D4007-11. The sample is heated in accordance with the procedure. If the two methods are in disagreement, the modified basic BS&W test is used. The modifications to the BS&W test includes: omission of dilution with toluene; demulsifier is not added; and the sample is centrifuged two times with the water and sediments values measured after each time. If the amount of sample is small, the ASTM D4007-11 procedure can be used with smaller centrifuge tubes, but if there is disagreement in any of these methods, the modified basic BS&W test is used with the centrifuge tubes specified in ASTM D4007-11.

"Percent fine particulate mercury" is limited to crude or condensates in which the mercury is predominantly non-volatile. It refers to the portion of mercury that cannot be removed from crude oil by vacuum filtration using a 0.45 micron filter at room temperature for crude oils that are fluid at room temperature, or at 10° C. above the pour point for crudes that are not fluid at room temperature. The filtration uses 25 mL samples of crude in 47 mm filters in glass vacuum filtration apparatus. If the crude is fluid at room temperature, the filtration is done at room temperature. If the crude is not fluid at room temperature, it is heated to approximately 10° C. above its pour point.

"Volatile Mercury" refers to mercury that can be removed by stripping with nitrogen. Elemental mercury is an example of a species which contributes to volatile mercury. Cinnabar and metacinnabar are examples of species which do not contribute to volatile mercury. Cinnabar and metacinnabar are examples of non-volatile mercury species.

"Percent volatile mercury" is measured by stripping 15 ml of crude or condensate with 300 ml/min of nitrogen (N2) for one hour. For samples which are fluid at room temperature, the stripping is carried out at room temperature. For samples which have a pour point above room temperature, but below 60° C., the stripping is done at 60° C. For samples which have a pour point above 60° C., the stripping is at 10° C. above the pour point. Mercury is measured on the original and stripped crude by the methods described under "Total Mercury". During stripping some oil may be evaporated along with the volatile mercury. This evaporation will concentrate the non-volatile mercury in the stripped crude. To correct for this concentration by evaporation, the loss in crude by evaporation is determined by weighing the initial crude and stripped crude. The percent loss in crude by evaporation is used to correct the total mercury determined in the stripped crude. This corrected value is then used to determine the percent volatile mercury.

"Predominantly non-volatile (mercury)" in the context of crude oil means that the percentage of total mercury in the crude oil that is volatile mercury is less than 50%. In another embodiment, the percentage that is volatile mercury is less than 25%. In yet another embodiment, the percentage that is volatile mercury is less than 15%.

"Non-leachable" refers to a mercury adsorbent that will not leach adsorbed mercury in a simulation of landfill disposal. To be non-leachable, the mercury in the adsorbent must meet TCLP standards established for the mercury listed in EPA's Land Disposal Restrictions: Summary of Requirements. Revised August 2001.

"Mercury sulfide" may be used interchangeably with HgS, referring to mercurous sulfide, mercuric sulfide, or mixtures thereof Normally, mercury sulfide is present as mercuric sulfide with a stoichiometric equivalent of approximately one mole of sulfide ion per mole of mercury ion. Mercury sulfide can be in any form of cinnabar, meta-cinnabar, hyper-cinnabar and combinations thereof.

"Ebullated" or "expanded" bed reaction system refers to a reactor system having an upflow type single reaction zone reactor containing adsorbent in random motion in an expanded catalytic bed state, typically expanded from 10% by volume to about 35% or more by volume above a "slumped" adsorbent bed condition (e.g. a non-expanded or non-ebullated state).

"Trace amount" refers to the amount of mercury in the crude oil. The amount varies depending on the crude oil source and the type of heavy metal, for example, ranging from a few ppbw to up to 100,000 ppbw for mercury and arsenic.

"Carbon number" represents a hydrocarbon molecule, and gives the total number of carbon atoms in the molecule. Thus, the term C4 represents hydrocarbon molecules having 4 carbon atoms per molecule.

"C4-hydrocarbons" or "C1-C4 hydrocarbons" represent a hydrocarbonaceous material having from 1 to 4 carbon atoms per molecule. Methane, ethane, propane, butane, their branched, cyclic, and olefinic analogs, and mixtures thereof are examples of C4-hydrocarbons. Unless otherwise specified, volatilization of C4-hydrocarbons may be accompanied by volatilization of other low boiling components of crude oil, including one or more of C5, C6, C7 and C8 hydrocarbons.

"True vapor pressure" refers to the equilibrium partial pressure exerted by a volatile organic liquid as a function of temperature as determined by the test method ASTM D 2879-97 (2007).

"Bubble point pressure" refers to the pressure at which a first bubble of gas evolves from a liquid as the pressure on the liquid is decreased. The bubble point pressure of a crude oil may be determined from a PVT analysis of a crude oil sample or calculated by a flash calculation procedure if the composition of the crude oil is known. Empirical correlations for estimating bubble point pressure from limited data are also known (see, for example, Petroleum Engineering Handbook, 2nd printing (June 1989), Society of Petroleum Engineers, Richardson, Tex., USA, p. 22-5.)

In one aspect, particulate mercury in crude oil is converted to elemental mercury by thermal decomposition. The product elemental mercury is removed from the crude oil by either vaporizing the elemental mercury or by adsorption of the elemental mercury from the crude oil onto a solid adsorbent. The process works at temperatures from 150 to 350° C. and at a pressure sufficient to limit the amount of crude vaporizing to be less than or equal to 10 wt. %. By limiting the crude vaporization, the energy usage required in this thermal process is minimized Energy is needed only to heat the crude, not to vaporize a large portion of it. The residence time of crude oil in a thermal treater is greater than or equal to 0.01 hours and less than or equal to 10 hours. If elemental mercury is present in the crude along with the particulate mercury, it too is removed in the process.

A crude oil feed that is treated in the process may contain dissolved gaseous hydrocarbons, including C4-hydrocarbons. Transportation requirements of crude oil feed, relating to vapor pressure and/or flash point specifications of the feed, may require that the crude oil feed be stabilized prior to shipping. In this regard, stability involves reducing the true vapor pressure of the crude oil to 9 psig or less. In one embodiment, the process includes converting particulate mercury in the crude oil feed to elemental mercury, and removing the elemental mercury, along with C4-hydrocarbons, during crude oil feed stabilization.

In order to eliminate the need for a separate gas stream to strip the elemental mercury from the crude oil, the crude oil can be thermally treated prior to stabilization—a process which removes C4-hydrocarbons. In one embodiment, the crude oil that is treated thermally can contain more than 0.1 wt. % of C4-hydrocarbons After thermal treatment, the crude is cooled, for example, to from 40 to 150° C. and the pressure is reduced to, for example, within a range from atmospheric pressure (0 psig) to 250 psig. The C4-hydrocarbons then vaporize from the crude and carry the elemental mercury with them. The elemental mercury in this hydrocarbon gas stream can then be removed by a solid adsorbent—a mercury removal adsorbent.

The process removes 10% or more of the mercury from a crude oil or condensate; in another embodiment, 50% or more; in another embodiment 75% or more; in another embodiment 90% or more.

The process produces a stable crude oil containing less than or equal to 500 ppbw mercury. In another embodiment, the process produces a stable crude oil containing less than or equal to 100 ppbw mercury. In another embodiment, the process produces a stable crude oil containing less than or equal to 50 ppbw mercury.

The process works for crude oil feeds that contain particulate mercury. In one embodiment, at least 10 wt. % of the total mercury contained in the crude oil feed is percent particulate. In another embodiment, at least 50 wt. % of the total mercury contained in the crude oil feed is particulate mercury. In another embodiment, at least 75 wt. % of the total mercury contained in the crude oil feed is particulate mercury.

The process is a method for removing mercury from a mercury-containing crude oil feed. The crude oil feed may be treated in the process as produced from a production wellbore, or following a vapor pressure reduction procedure to remove some highly volatile hydrocarbons, including C4-hydrocarbons, from the crude oil feed. In one embodiment, the crude oil feed is an unstabilized crude oil, containing volatile hydrocarbons. A crude oil feed that can be treated in the process contains 0.1 wt. % or more C4-hydrocarbons. An exemplary crude oil feed contains in a range from 0.1 to 10 wt. % C4-hydrocarbons. Another exemplary crude oil feed contains from 0.1 to 5 wt. % C4-hydrocarbons. Such a crude oil feed has a true vapor pressure of greater than 9 psig. An exemplary crude oil feed for the process has a true vapor pressure in a range of between greater than 9 psig and less than or equal 14 psig.

The process may be employed with crude oils containing mercury over a wide range may be treated as disclosed herein. Use of the method is preferred for higher amounts of mercury, since the benefits of removing mercury from highly contaminated crude oil and condensates are great. In practice, the method is applied over any range of amounts of mercury that are detrimental to the value of crude oil containing the mercury, or detrimental to processes and personnel involved in processing the crude oil, and can range from a few ppbw to up to 100,000 ppbw. Practically, the method may be applied to crude oil or condensates containing 10 ppbw or more of total mercury. In embodiments, the method may be usefully used to treat crude oil containing 50 ppbw or more of total mercury. Exemplary high mercury crude oil contains 100 ppbw or more of total mercury; or 250 ppbw or more of total mercury, or 1000 ppbw or more of total mercury.

The crude oil feed may contain mercury in one or more of a number of different forms, including elemental mercury (e.g., Hg0), particulate mercury (e.g. mercury sulfide, mercury oxide, and mercury sulfate), mercury alky complexes (e.g. dimethyl mercury) and cationic mercury. An exemplary particulate mercury is mercury sulfide (e.g. HgS). In an exemplary crude oil feed, at least 10 wt. % of the total mercury in the crude oil feed is particulate mercury. In one embodiment, at least 25 wt. % of the total mercury is particulate mercury. In one embodiment, at least 50 wt. % of the total mercury is particulate mercury.

In one embodiment, a stabilized crude oil is prepared in the process. Stabilizing the crude oil involves removing a portion of the C4-hydrocarbons from an unstabilized crude oil; removal of the C4-hydrocarbons may be done in a single step or in multiple steps. In a multiple step process, the first step removes some of the C4-components from the crude oil feed to make a partially stabilized crude oil, and a second step removes additional C4-components while concurrently removing elemental mercury from the partially stabilized crude oil, forming a stabilized crude oil having a reduced content of mercury.

Stabilized crude oil recovered from the separation unit contains less than 500 ppbw total mercury. In embodiments, the stabilized crude oil contains in a range from 10 to 500 ppmw total mercury; or from 20 to 200 ppmw total mercury. An exemplary stabilized crude oil contains less than 100 ppbw total mercury.

The stabilized crude oil has a total mercury content that is less than that of the crude oil feed. An illustrative stabilized crude oil prepared in the process contains at least 10 wt. % less total mercury than is contained in the crude oil feed. Another illustrative stabilized crude oil prepared in the process contains at least 50 wt. % less total mercury than is contained in the crude oil feed. Another illustrative stabilized crude oil contains at least 75 wt. % less total mercury than is contained in the crude oil feed.

The stabilized crude oil further has a vapor pressure less than or equal to 9 psia. In one embodiment, the stabilized crude oil contains less than 0.1 wt. % of C4-hydrocarbons.

The crude oil feed may be prepared for the mercury removal method by a preliminary dewatering step. Methods to separate water and brine solutions from crude oil are well known and practiced worldwide. Exemplary methods include liquid-liquid separations, and separations using a demulsifier. Such methods are generally practiced at a temperature approximately equal to the temperature of the crude entering the dewatering process, and are generally conducted at a temperature in a range from 25 to 200° C. and at pressure in a range of 1 atmosphere to 10 atmospheres.

In one embodiment, the crude oil feed may be prepared for mercury removal by a preliminary stabilization step, for removing amounts of high volatility components from the crude oil above what is required for mercury removal. A preliminary stabilization step requires little or no added heat, to avoid conversion of mercury in the crude oil to elemental mercury at this point. In one embodiment, a preliminary stabilization step involves passing the crude oil through a preliminary separation unit, optionally supplied with internal features and optionally with a gas purge to facilitate removal of excessive high volatility components from the crude oil. In one embodiment, the high volatility components include C4-hydrocarbons. In one embodiment, the preliminary stabilization step produces a partially stabilized crude oil containing in a range from 0.1 to 5 vol. % C4-hydrocarbons. In one embodiment, the partially stabilized crude oil has a true vapor pressure in a range of between greater than 9 psig and less than or equal 14 psig.

In the process, the crude oil feed is heated in a thermal decomposition step at a temperature to convert mercury in the crude oil feed, including particulate mercury, to elemental mercury. An exemplary temperature of the thermal decomposition step is in a range from 150° C. to 350° C. In an embodiment, the temperature is in a range from 175° C. to 300° C. The pressure of the crude oil feed during thermal decomposition is sufficiently high to retain the elemental mercury in the crude oil, and to minimize elemental mercury vaporization at this point. An exemplary pressure of the thermal decomposition step is in a range from 100 psig to 5000 psig. In one embodiment, the pressure during thermal decomposition is in a range from 250 psig to 1500 psig.

The thermal decomposition step may be conducted in a thermal decomposition reactor. The thermal decomposition reactor may be a static batch reactor, a continuous stirred tank reactor or a flow reactor, through which the crude oil continuously flows as the decomposition reactions take place in the heated crude oil. Flow through a flow reactor may be in an upward, downward, or horizontal direction. The thermal decomposition reactor may include internal elements to improve heat flow through the crude oil and to improve mixing of the crude oil. The thermal decomposition reactor may also contain solid particles to improve heat transfer and promote the mercury decomposition reactions.

Crude oil is treated in the thermal decomposition step for at least 1 minute. Exemplary treatment options include treating for a period of from 1 to 30 minutes, or for a period from 10 to 30 minutes. Residence time of the crude oil in a thermal decomposition reactor is, in embodiments, in a range from 0.1 hr-1 to 10 hr-1, or in a range from 0.5 hr-1 to 5 hr-1. In one embodiment, no catalyst is included in the reactor during thermal decomposition. In one embodiment, a stripping gas is not provided for the reactor during thermal decomposition.

The crude oil feed to a thermal decomposition step is an unstable crude oil, containing C4-hydrocarbons and having a true vapor pressure above 9 psig. Depending on the crude oil used, the crude oil feed may optionally have been partially stabilized in a preliminary stabilization step. During the thermal decomposition step, particulate mercury in the crude oil converts (i.e., decomposes) to elemental mercury, Hg0. In one embodiment, at least 25 wt. %, in one embodiment at least 50 wt. %, and in one embodiment at least 75 wt. % of the particulate mercury in the crude oil feed is converted to elemental mercury during thermal decomposition.

In one embodiment, process conditions during the thermal decomposition step are selected to retain C4-hydrocarbon gases in the liquid phase crude oil feed. This may be achieved, for example, by maintaining the pressure during the thermal decomposition step of above the bubble point of the crude oil, while maintaining a temperature at least equal to the decomposition temperature of the mercury in the crude oil feed at the decomposition pressure. In another aspect, the pressure is maintained such that, in embodiments, no more than 10 wt. %; or no more than 5 wt. %; or no more than 1 wt. % of the crude oil is vaporized during heating. While some of the volatile components present in the crude oil feed are vaporized during heating, the pressure is maintained such that the amount of C4-vaporization is controlled. The pressure during thermal decomposition is controlled to retain, in embodiments, at least 80 vol. %, or at least 90 vol. % of the C4-hydrocarbons in the liquid phase crude oil during the thermal decomposition step.

The elemental mercury which is formed in the crude oil feed during thermal decomposition is removed from the crude oil in a following separation step. In one embodiment, elemental mercury is vaporized during the separation. The vaporization is facilitated in the process by the use of C4-hydrocarbons remaining in the crude oil feed at the end of the decomposition step. The temperature and the pressure of the crude oil during separation are selected to enhance vaporization of C4-hydrocarbons in the crude oil, thereby stripping elemental mercury from the crude oil. In effect, the temperature and pressure of the separation step are selected to stabilize the crude oil by removing dissolved C4-hydrocarbon gases from the crude oil. Separation of C4-gases from the crude oil has the additional effect of sweeping elemental mercury from the crude oil into the gas phase, in combination with the vaporizing C4-gases.

Process conditions employed during separation are selected to cause vaporization of the C4-from the crude oil to reduce the C4-content of the liquid hydrocarbon, in embodiments, to less than 2 wt. %; or to less than 1.5 wt. %; or to less than 1 wt. %. The separation is conducted at a temperature, in embodiments, of less than 200° C.; or in a range from 25° C. to 200° C.; or in a range from 40° C. to 150° C.; or in a range from 60° C. to 100° C. The separation is conducted at a pressure that is less than the first pressure. In embodiments, a separation pressure may be less than 1000 psig; or less than 250 psig; or in a range from atmospheric pressure (0 psig) to 250 psig; or in a range from 10 to 200 psig.

Vaporization may be enhanced by conducting the separation in a separation zone that is configured to enhance removal of volatile compounds. Vaporization may be further enhanced to introduction of a stripping gas, such as nitrogen, for stripping volatile compounds from the crude oil.

The separation step may be conducted for a period of a few minutes, up to a period of hours. When the sole stripping medium is vaporization of C4-hydrocarbons from the crude, the separation step may have a residence time of greater than 0.01 hours. In embodiments, the residence time is in a range from 0.01 hours to 10 hours; or from 0.1 hours to 2 hours; or from 0.5 hours to 1.5 hours.

A separator zone that may be used in the separation step may include, for example: a packed column, a plate column, or a bubble column, each being filled with a filler such as a Raschig ring, a Pall ring, an Intalox (registered trademark) saddle, a Berl saddle, and a Goodloe (registered trademark) packing. The separator may be a device which distributes the liquid hydrocarbon from the liquid injection point near the top of the column and facilitates the vaporization of dissolved C4-hydrocarbons from the crude oil through the column. The separator may include an electrostatic grid to assist in the removal of traces of water droplets. The separator further facilitates contact between liquid and gaseous hydrocarbons in the column, thereby transferring the elemental mercury in the liquid hydrocarbon to the vaporized C4-stripping gas, and then withdraws the first gaseous hydrocarbon containing elemental mercury and the Hg-depleted liquid hydrocarbon from the bottom of the column.

In one embodiment, the separation step includes contacting the crude oil from the decomposition step with an adsorbent, for reacting with the elemental mercury and removing the mercury from the crude oil.

When the adsorbent is employed after the thermal decomposition stage, the crude oil is generally cooled to a temperature below the thermal decomposition temperature and to a pressure below the thermal decomposition pressure, and contacted with an adsorption bed containing particulate adsorbent, for adsorbing elemental mercury from the crude oil. Various processes well-known in the industry are available for adsorption. The adsorption can be performed using extrudates, granules or tablets in a fixed bed where the crude oil flows either downflow or upflow. Fixed beds may encounter plugging problems due to the fines in the crude. One way to prevent this is to use a guard bed of high pore volume material to capture the fines and prevent formation of a non-porous crust. The adsorption process can also be performed in a fluidized bed or ebullated bed or continuously stirred tank reactor (CSTR) reactors. These options are suitable for use when the total particulate content of the crude is high enough to cause plugging in a fixed bed even with use of a guard bed. Alternatively, the formation of plugs can be prevented by use of sonication or pulsed flow. Both gently agitate the particles and prevent the formation of a crust. The adsorption can also be performed in processes known as mixer-settlers using fine particulate adsorbents which are mixed with the crude and then removed by settling, filtration, centrifugation, hydrocyclones and combinations. Multiple adsorbent units of any type can be used in series. Typically this is a lead-lag operation where the first adsorber (lead) is removing the majority of the mercury and the second adsorber (lag) removes the final traces. When the first adsorber is spent and mercury concentrations in the outlet of the first adsorber increase, the inlet flow is reversed to the second adsorber and the first adsorber it taken off-line to replace the adsorbent. It is then brought back on-line and operates in the lag position. When an adsorbent is used in a fixed bed, fluidized bed, ebullated bed or expanded bed, the space velocity may, in embodiments, be greater than or equal to 0.01 hr-1; or in a range from 0.1 to 25 hr-1; or in a range from 1 to 5 hr-1. For ebullated or expanded beds, the space velocity may be based on the bed volume before ebullition or expansion. The particulate adsorbent may be added to the crude oil during or after the thermal decomposition step, or may be supplied to the crude oil in a separate vessel downstream of a thermal decomposition reactor. Elemental mercury may be vaporized from the crude oil during the adsorbent separation step, either by reason of the temperature of the crude oil or on account of the use of a stripping gas, either generated in situ in the crude oil or supplied externally. However, in one embodiment, the separation process using the adsorbent is controlled to prevent, or at least minimize, elemental mercury vaporization.

A portion of the particulate mercury, and solids of all types, can be removed in advance of this process by use of filtration, centrifugation, hydrocyclones and settling.

The temperature of the crude oil in contact with an adsorbent during the separation step is generally within a range below 200° C., or, in embodiments, within a range of 20° C. to 200° C., or within a range of 40° C. to 150° C. The pressure of the crude oil in contact with an adsorbent during the separation step is generally less than 1500 psig; or, in embodiments, less than 1000 psig; or in a range from 50 psig to 1000 psig; or in a range from 100 to 750 psig.

When a particulate adsorbent is mixed with the treated crude, the amount of adsorbent added, in embodiments, is greater than 0.001 wt. %; or in a range from 0.01 to 10 wt. %; or in a range from 0. 1 to 2 wt. %.

An effective particulate adsorbent may have an average particle diameter in a range from 0.1 mm to 10 mm; in embodiments, in a range from 0 5 mm to 5 mm; or from 1 mm to 10 mm.

Adsorbents useful for removing mercury from liquid hydrocarbons are those which comprise constituents chemically reactive with mercury or mercury compounds. Examples include carbons, sulfided carbons, halogen-treated carbons, clays, zeolites and molecular sieves, and supported or unsupported metal sulfides. Cupric sulfide is an example of a metal sulfide. Various cationic forms of several zeolite species, including both naturally occurring and synthesized compositions, exhibit appreciable capacities for mercury adsorption due to the chemisorption of metallic mercury at the cation sites. Some of these zeolitic adsorbents reversibly adsorb mercury and others exhibit less than full, but nevertheless significant, reversibility. An especially effective adsorbent is one of the zeolite-based compositions containing cationic or finely dispersed elemental forms of silver, gold, platinum or palladium. Zeolites X and A are effective for this purpose. These adsorbents, as well as the other zeolite-based adsorbents containing ionic or elemental gold, silver, platinum, or palladium, are capable of selectively adsorbing and sequestering organic mercury compounds as well as elemental mercury. Activated carbon may also be used as an effective mercury adsorbent. The specific mention of these materials is not intended to be limiting, the composition actually selected being a matter deemed most advantageous by the practitioner give the particular circumstances to which the process in applied.

The crude oil following the separation step has a total mercury content that is less than that of the crude oil feed. An illustrative crude oil prepared in the process contains at least 10 wt. % less total mercury than is contained in the crude oil feed. Another illustrative crude oil prepared in the process contains at least 50 wt. % less total mercury than is contained in the crude oil feed. Another illustrative crude oil contains at least 75 wt. % less total mercury than is contained in the crude oil feed.

In an embodiment, the C4-hydrocarbons, containing elemental mercury from the separation step, may be treated to separate the mercury from the hydrocarbons, using a mercury adsorber or a scrubber to treat the stripping gas after it exits the stripper. Adsorbents useful for removing mercury from gaseous hydrocarbons are those which comprise constituents chemically reactive with mercury or mercury compounds. Examples include carbons, sulfided carbons, halogen-treated carbons, clays, zeolites and molecular sieves, and supported or unsupported metal sulfides. Cupric sulfide is an example of a possible metal sulfide. Activated carbon may also be used as an effective mercury adsorbent. Active metal compounds may be supported on solid materials, such as carbon and alumina. The adsorber is sufficiently large to remove at least ninety percent of the mercury from the stripping gas. Typical superficial gas velocity through the bed is generally in a range from 0.1 to 50 ft/s, with one embodiment in a range from 0.5 to 10 ft/s. Depending upon the nature and activity of the adsorbent, the temperature is generally maintained in a range from 10° C. to 200° C., with an embodiment in a range from 20° C. to 100° C. If the adsorption bed is to be regenerated the purge medium is heated to at least 100° C., and preferably at least 200° C., higher than the temperature of the feedstock being purified. Pressure conditions can range from about 0 to 250 psig.

FIG. 1 illustrates an embodiment of the invention. In FIG. 1, particulate mercury is removed from a mercury-containing unstabilized crude oil that contains in a range from 0.1 wt. % to 5 wt. % C4-hydrocarbons. The crude oil (11) is obtained from a subsurface reservoir (10), where the surface is illustrated at (12) and sent to initial separators (20). These separators produce a first gas stream (21), an unstabilized crude oil (22) and produced water (23). The unstabilized crude contains in a range from 0.1 wt. % to 5 wt. % (e.g. 1 wt. %) C4-hydrocarbons. The unstabilized crude also contains greater than 100 ppbw (e.g. 1000 ppbw) total mercury, with greater than 50 wt. % (e.g. 75 wt. %) of the total mercury being in the form of particulate mercury. The unstabilized crude oil is pressured within a range from 100 psig to 5000 psig (e.g. 1000 psig) by a pump (30) and heated at a temperature within a range of 100° C. to 300° C. (e.g. 250° C.) by equipment not shown. The selected pressure is above the bubble point pressure of the unstabilized crude. The heated unstabilized crude oil enters a thermal decomposition reactor (40) where it flows upward and has a residence time of greater than 1 minute (e.g. 30 minute). The thermal decomposition reactor converts the particulate mercury to elemental mercury. After the thermal decomposition reactor, the treated unstabilized crude oil (41) is cooled to less than 200° C. (e.g. 90° C.) by equipment not shown and the pressure is reduced to from 0 to 250 psig (e.g. 10 psig) by equipment not shown. The depressurized crude is sent to a treater degasser (60) to recover C4-hydrocarbons as a second gas (61). The temperature of the treater degasser is less than 200° C. (e.g. 90° C.) and the crude has a residence time of from 10 minutes to 12 hours (e.g. one hour). The treater degasser produces a stabilized crude (62) that contains less than 500 ppbw (e.g. 50 ppbw) total mercury. The first gas stream (21) and the second gas stream (61) are blended and sent to a gas-phase mercury removal unit using a cupric sulfide adsorbent (70). This mercury removal unit produces a treated gas (71) having a mercury content of less than 1 μg Hg per normal m3.

Figure 2:
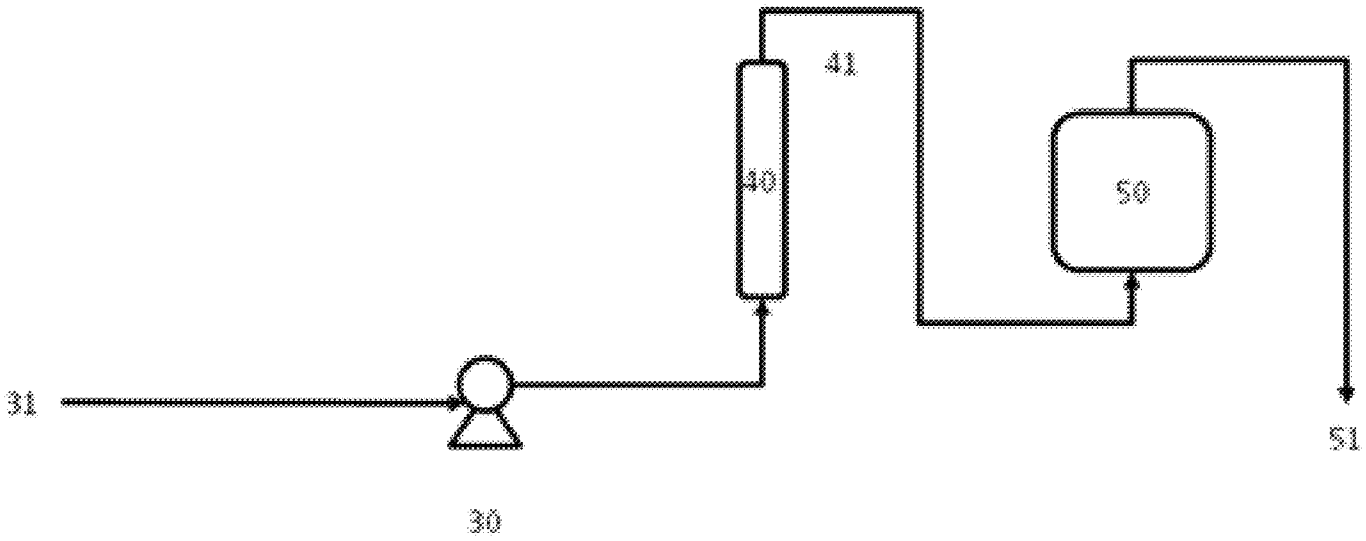
FIG. 2 illustrates an embodiment of the process, having a thermal decomposition reactor for converting mercury in crude oil to elemental mercury, and an adsorption bed that produces a low mercury crude oil.

FIG. 2 illustrates another embodiment of the Invention. In FIG. 2, the particulate mercury in a high mercury crude is thermally decomposed to form elemental mercury. The elemental mercury is removed by use of a mercury adsorber that directly processes the liquid crude. This embodiment utilizes existing equipment that is common in oil production operations: the initial separators, the treater-degasser that is used to prepare the stabilized crude, and the mercury removal unit that is used to treat the gas. This embodiment avoids the use of a separate stripping gas.

A high mercury crude that contains 1000 ppbw total mercury with a percent particulate mercury of 75%, (31) is heated to 250° C. by equipment not shown and pressured to 500 psig by a pump (30), a pressure that is above the bubble pressure of the crude. The heated crude enters a thermal decomposition reactor (40) where it flows upward and has a 30 minute residence time. The thermal decomposition reactor converts the particulate mercury to elemental mercury. After the thermal decomposition reactor, the treated crude (41) is cooled to 90° C. by equipment not shown. The pressure is maintained at near 500 psig and the crude enters an ebullated bed adsorber that contains a cupric sulfide adsorbent (50) and which produces a low mercury crude containing less than 50 ppbw mercury (51). The adsorber operates at 90° C. and has a residence time of 0.25 hours. The average diameter of the adsorbent is 2 mm, and the ratio of the diameter of the vessel to the diameter of the particles is >14. The pressure of the low mercury crude is reduced to atmospheric and the crude is stored in a tank (not shown).

EXAMPLES

The illustrative examples are intended to be non-limiting.

Example 1

In this example, a sample of volatile Hg0 in simulated crude was prepared. First, five grams of elemental mercury Hg0 was placed in an impinger at 100° C. and 0.625 SCF/min of nitrogen gas was passed over through the impinger to form an Hg-saturated nitrogen gas stream. This gas stream was then bubbled through 3123 pounds of Superla® white oil held at 60-70° C. in an agitated vessel. The operation continued for 55 hours until the mercury level in the white oil reached 500 ppbw by a Lumex™ analyzer. The simulated material was drummed and stored.

Example 2

The example illustrates the stripping of volatile Hg0 from a crude oil. First, 75 ml of the simulated crude from Example 1 was placed in a 100 ml graduated cylinder and sparged with 300 ml/min of nitrogen at room temperature. The simulated crude had been stored for an extended period of time, and its initial value of mercury had decreased to about 369 ppbw due to vaporization (time at 0 min in Table 1). The mercury in this simulated crude was rapidly stripped consistent with the known behavior of Hg0, as shown in Table 1. The detection limit of the Lumex™ analyzer is about 50 ppbw; the effective level of mercury beyond about 60 minutes was below the detection limit.

TABLE 1

| Table 1 | |
|---|---|
| Time, min | Mercury, ppbw |
| 0 | 369 |
| 10 | 274 |
| 20 | 216 |
| 30 | 163 |
| 40 | 99 |

TABLE 1-continued

| Table 1 | |
|---|---|
| Time, min | Mercury, ppbw |
| 50 | 56 |
| 60 | 73 |
| 80 | 44 |
| 100 | 38 |
| 120 | 11 |
| 140 | 25 |
| % Volatile Hg | 80 |

Superla® white oil is not volatile and there were no significant losses in the mass of the crude by evaporation. Thus the mercury analyses of the stripped product did not need to be corrected for evaporation losses.

The mercury in this crude is volatile. Filtering this simulated crude through a 0.45 micron syringe filter to avoid losses of volatile mercury resulted in no change in the mercury content. This in an example of a volatile mercury crude and a non-particulate mercury crude.

Examples 3-6

Determination of the Percent Volatile Mercury in Crudes by Stripping

The mercury content in the vapor space of these six samples was measured by a Jerome analyzer and found to be below the limit of detection. Thus this indirect qualitative method indicates that there is no volatile mercury in these samples.

The initial total mercury content of the six samples was determined and then the samples were stripped as indicated. The loss of weight of crude by evaporation was determined, and the total mercury in the stripped crude was measured. The percent volatile mercury was determined from these values based on a corrected value for the stripped total mercury to account for losses in the crude by evaporation using the following formula.

$$\text{Percent volatile Hg}=100*X1-[(100-X2)*(X3)/100]/X1$$

where: X1=(Total Hg in the original sample); X2=(% Oil Loss); X3=(Hg in stripped sample)

All samples contained predominantly non-volatile mercury. Results are summarized in Table 2.

TABLE 2

| | Example | | | |
|---|---|---|---|---|
| | Condensate 3 | Condensate 4 | Condensate 5 | Crude 6 |
| Volatile Hg by Jerome, μg/m3 | 0.00 | 0.00 | 0.00 | 0.00 |
| Total Hg by Lumex (or CEBAM), ppbw | 2,102 | 1,388 | 1,992 | 9,050 |
| Hg after 1 hr RT stripping, ppbw | 2,357 | 1,697 | 2,787 | 8,951 |
| Oil loss after 1 hr RT stripping, wt. % | 14.00 | 10.83 | 30.01 | 16.01 |
| Percent Volatile Hg | 4 | −9 | 2 | 17 |

All these crudes and condensates are examples of predominantly non-volatile mercury-containing crudes and condensates.

Volatile mercury compounds, such as elemental mercury, can be found in crudes and condensates sampled near the well-head. These have not been stabilized to remove light hydrocarbon gases (methane, ethane, propane, and butanes). The stabilization process typically removes most if not all of the elemental mercury from crudes and condensates.

Examples 7 to 16

Size Distribution of Particulate Mercury in Crudes and Condensates

Ten crude and condensate sample were vacuum filtered through 47 mm filters with pore sizes of 20, 10, 5, 1, 0.45 and 0.2 μm. The temperature of the filtration was set above the crude pour point. The total mercury in the crudes, condensates and their filtrates was determined by Lumex. The amount of mercury in each size fraction was determined by comparing the amount removed in successive filter sizes. On occasion, this resulted in negative numbers, which should be interpreted as meaning that there was little or no particulate mercury in this size range. Results are summarized in Table 3.

TABLE 3

| Ex. No | Sample ID | Filtering Temp. ° C. | Hg, ppbw | Percent Hg removed in each size >20 μm % | 10-20 μm % | 5-10 μm % | 1-5 μm % | 0.45-1 μm % | 0.2-0.4 μm % | <0.2 μm % | % Part. Hg >0.45 μm | % Part. Hg By Centrifuge |
|---|---|---|---|---|---|---|---|---|---|---|---|---|
| 7 | Crude-1 | 65 | 1,947 | 42 | 10 | 1 | −4 | 34 | 1 | 16 | 83 | |
| 8 | Crude-1 NA | 70 | 1,256 | 35 | 18 | 21 | 7 | 4 | 0 | 16 | 84 | |
| 9 | Condensate-1 | 25 | 2,102 | 89 | 5 | −3 | 3 | 6 | 1 | 0 | 99 | 92 |
| 10 | Condensate-2 | 48 | 1,510 | 3 | 0 | 8 | 12 | 3 | −2 | 76 | 26 | 22 |
| 11 | Crude-2 | 70 | 230 | 19 | 10 | 19 | −2 | 25 | 1 | 28 | 71 | |
| 12 | Crude-3 | 70 | 360 | 16 | 8 | 9 | −1 | 24 | 2 | 43 | 55 | |
| 13 | Crude-4 | 70 | 429 | 9 | −8 | 19 | −2 | 32 | 2 | 48 | 50 | |
| 14 | Crude-5 | 70 | 940 | 14 | 59 | 14 | 0 | 5 | 0 | 8 | 92 | |
| 15 | Condesate-3 | 40 | 2,021 | 11 | 3 | 15 | −14 | 29 | −1 | 57 | 45 | 31 |
| 16 | Crude-2 | 25 | 9,050 | 16 | 16 | 11 | 32 | 20 | 1 | 4 | 95 | 69 |

The data show that the size distribution of mercury-containing particles in crudes and condensates varies significantly. The presence of fine particles, those with sizes of 0.45 μm and below, will present a problem for processes which remove mercury particles by filtration, centrifugation or settling.

All of these are examples of high mercury crudes and high mercury condensates. All of these have a percent particulate mercury concentration of 10% or more. All these except number 9 are examples of fine-particulate high-mercury crudes and condensates.

Mercury which passes through the smallest filter tested, 0.2 μm, is believed to be fine metacinnabar particles. EXAFS analysis of a series of solids removed from crudes detects only metacinnabar, and on occasion, a small amount of related solid mercury dithiol species with EXAFS structures matching the mercury-cysteine complex.

The percent particulate Hg is measured by filtration using a 0.45 micron filter and by centrifugation (data from Table 5). For most examples, the two methods agree. When they differ, the method described in the definition should be used.

Examples 17 to 21

In these examples, metacinnabar are determined as the Hg species in stabilized crude. The examples show that the predominant form of mercury in solid residues from various stabilized crudes is metacinnabar. The metacinnabar particles are either very small (nanometer scale), highly disordered, or both.

Solid residues from several crudes were analyzed by EXAFS to determine the composition of the solids components. The mercury coordination number (CN) was also measured. Efforts were made to look for other species, but they could not be detected and must be present at levels much less than 10%. The searched-for species include: elemental mercury (on frozen samples), mercuric oxide, mercuric chloride, mercuric sulfate, and Hg3S2C12. Also the following mineral phases were sought and not found: Cinnabar, Eglestonite, Schuetite, Kleinite, Mosesite, Terlinguite. Results are shown in Table 4, showing a summary of Hg species identified in the samples and the calculated first shell coordination number for each Hg species.

TABLE 4

| Example | Source | Species (%) | Coordination number |
|---|---|---|---|
| 17 | Crude-1 (toluene washed) | B-HgS (101)<br>HgSe (10) | 2.61 ± 0.26 |
| 18 | Crude-3 (as is) | B-HgS (91)<br>Hg-$(SR)_2$ (24) | 2.40 ± 0.98<br>1.22 ± 0.85 |
| 19 | Crude 1 | B-HgS (104) | 2.61 ± 0.17 |
| 20 | Crude-5 | B-HgS (139) | 3.46 ± 0.21 |
| 21 | Crude 1 SA | B-HgS (129) | |

The percentages of mercury in the samples were calculated by comparison to standards and with measurement of the mercury content of the sample. Metacinnabar (B—HgS) is the predominant species for all stabilized crudes obtained from around the world. On occasion traces of mercury selenide are seen. Higher amounts of related mercury dithiol (Hg—(SR)2) can be seen in samples that are not washed with toluene solvent. The dithiol is believed to be an intermediate product from the reaction between elemental mercury and mercaptans. It eventually condenses to form metacinnabar which adsorbs on the surface of the formation material. The standard used for analysis of the dithiol was HgCysteine. The coordination numbers below 4 indicate that the metacinnabar crystallites are either very small (nanometer scale), or are very poorly crystalized, or both.

SEM and TEM studies show that the metacinnabar can be present as either micron-sized aggregates of nanometer sized metacinnabar crystallites, or as nanometer sized metacinnabar crystallites coating the outside of other micron-sized solids, typically formation material—quartz, clay and the like. Because the metacinnabar crystallites are in the nanometer size range, they are difficult or impossible to detect by conventional XRD because of line broadening. The metacinnabar nanoparticles can also be converted to diethyl mercury using ethyl chloride. Reagent metacinnabar powders show little or no reactivity presumably due to their lower surface area and larger crystal size.

Examples 22 to 26

Determination of Percent Particulate Hg by Centrifugation

Ten ml of the following seven crudes were placed in a small centrifuge tube. Samples that were fluid at room temperature were centrifuged at room temperature. Samples that were waxy at room temperature were heated to 40° C. The samples were spun at 1800 RPM for 10 minutes. The mercury content of the supernatant was measured by Lumex® and compared to the mercury content of the original sample, and the ratio was used to calculate the percent particulate mercury. Results are summarized in Table 5.

TABLE 5

| Example | Sample ID | Percent Particulate Hg by Centrifuge |
|---|---|---|
| 22 | Condensate-1 | 92 |
| 23 | Condensate-6 | 80 |
| 24 | Condensate-2 | 22 |
| 25 | Condensate-3 | 31 |
| 26 | Crude-2 | 69 |

Percent Particulate Mercury=100*(Original Hg-Centrifuged Hg)/(Original Hg)

Comparative Examples 27 and 28

These examples show that commercial adsorbents designed to remove elemental mercury from liquids and gases are highly effective in removing volatile elemental mercury from this simulated crude.

PURASEC® 5158, and JM Catalyst CP662 are commercial adsorbents from Johnson Matthey designed to remove elemental mercury from hydrocarbon liquids, such as refinery naphthas. PURASEC® 5158 contains cupric sulfide and alumina It has been passivated to prevent rapid oxidation in air. JM Catalyst CP662 is a clay that does not contain a metal sulfide.

0.1 grams of each material were placed in 40 ml VOA vials. 10 ml of the volatile Hg0 in simulated crude from example 1 was added. These were then mixed overnight on a rotating disc and allowed to settle. The final mercury content of the supernatant was compared to the initial Hg, and used to calculate the percent removed by adsorption and settling. The results are shown in Table 6 below.

TABLE 6

| Example | Adsorbent | Initial Hg, ppbw | Final Hg, ppbw | Percent Removed |
|---|---|---|---|---|
| 27 | PURASEC ® 5158 | 380 | 18 | 95.25 |
| 28 | JM Catalyst CP662 | 380 | 26 | 93.16 |

Both materials are highly effective in removing volatile elemental mercury from this simulated crude.

Comparative Examples 29 to 34

These examples show that commercial adsorbents designed to remove elemental mercury from liquids and gases are ineffective in removing non-volatile particulate mercury from crude oil.

The Johnson Matthey adsorbents of examples 27 and 28 were tested as described in Examples 17 and 18 but with a crude and a condensate. The crude had an average particle size determined by filtration of 11 microns. The condensate had a smaller average particle size of 6 microns. Since the mercury in these samples is particulate, some amount will settle in the absence of an adsorbent. The effectiveness of an adsorbent must be judged by the increase in removal compared to settling without an adsorbent. Results are shown below in Table 7.

TABLE 7

| Example | Adsorbent | Crude | Percent Removed |
|---|---|---|---|
| 29 | None-Control | NA. Crude | 32 |
| 30 | PURASEC ® 5158 | NA. Crude | 39 |
| 31 | JM Catalyst CP662 | NA. Crude | 17 |
| 32 | None-Control | SEA Cond. | 37 |
| 33 | JM Catalyst CP662 | SEA Cond. | 0 |
| 34 | JM Catalyst CP662 | SEA Cond. | 25 |

These results show that the commercial adsorbents which work well to remove elemental mercury are ineffective in removing non-volatile particulate mercury. The amount removed was much less than 100%, and about the same as was removed by settling alone in the absence of an adsorbent.

Comparative Examples 35 and 36

These examples show that commercial adsorbents designed to remove elemental mercury from liquids and gases are highly effective in removing volatile elemental mercury from this simulated crude.

Adsorbents used commercially to remove elemental mercury from hydrocarbon liquids include copper-alumina and clay-containing materials. Adsorbents of both classes were evaluated. The clay-adsorbent contained Attapulgite.

0.1 grams of each material were placed in 40 ml VOA vials. 10 ml of the volatile Hg0 in simulated crude from example 1 was added. These were then mixed overnight on a rotating disc and allowed to settle. The final mercury content of the supernatant was compared to the initial Hg, and used to calculate the percent removed by adsorption and settling. The results are shown in Table 8 below.

TABLE 8

| Example | Adsorbent | Initial Hg, ppbw | Final Hg, ppbw | Percent Removed |
|---|---|---|---|---|
| 35 | Copper-Alumina | 380 | 18 | 95.25 |
| 36 | Attapulgite | 380 | 26 | 93.16 |

Both materials are highly effective in removing volatile elemental mercury from this simulated crude.

Comparative Examples 37 to 42

These examples show that commercial adsorbents designed to remove elemental mercury from liquids and gases are ineffective in removing non-volatile particulate mercury from crude oil.

The adsorbents of examples 35 and 36 were tested as described in Examples 17 and 18 but with a crude and a condensate. The crude had an average particle size determined by filtration of 11 microns. The condensate had a smaller average particle size of 6 microns. Since the mercury in these samples is particulate, some amount will settle in the absence of an adsorbent. The effectiveness of an adsorbent must be judged by the increase in removal compared to settling without an adsorbent. Results are shown below in Table 9.

TABLE 9

| Example | Adsorbent | Crude | Percent Removed |
|---|---|---|---|
| 37 | None-Control | Crude 1 | 32 |
| 38 | Copper-alumina | Crude 1 | 39 |
| 39 | Attapulgite | Crude 1 | 17 |
| 40 | None-Control | Cond. 1 | 37 |
| 41 | Copper-alumina | Cond. 1 | 0 |
| 42 | Attapulgite | Cond. 1 | 25 |

These results show that the adsorbents which work well to remove elemental mercury are ineffective in removing non-volatile particulate mercury. The amount removed was much less than 100%, and about the same as was removed by settling alone in the absence of an adsorbent.

Example 43

This procedure was used to study the thermal decomposition of particulate mercury in crudes at atmospheric pressure. As elemental mercury was formed, it was continually stripped by a stream of nitrogen gas.

One hundred ml of crude was placed in a 250 ml round bottom flask. The flask also contained a magnetic stir bar and a glass tube which supplied 300 ml/min of nitrogen gas below the level of crude in the flask. The flask was wrapped with a heating mantle, and placed on a magnetic stirrer. The nitrogen gas that exited the flask went first to a condenser which collected naphtha formed from heating the crude. Then the gas went to a second impinger filled with 200 ml of 3 wt. % sodium polysulfide solution. The sodium polysulfide adsorbed the elemental mercury and converted it into a non-volatile compound, presumably HgS2H—.

At the start of the experiment, the vessels were sealed, the stirrer was started, and the nitrogen flow was started. Then the flask was heated rapidly to the desired temperature. The heating was typically complete in 15 minutes. The temperature was maintained for the duration of the experiment—from one hour to six hours. The mercury contents of the crude, polysulfide, and gases leaving the flask and polysulfide scrubber were measured by Lumex®. The mercury content of the crude declined with time and the mercury content of the polysulfide increased. Mercury was never detected in any significant amount in the naphtha or in the gas leaving the polysulfide scrubber. The mass balance for mercury varied from 52 to 115%. Missing mercury was assumed to be adsorbed on the glass tubing walls which were also wet with small amounts of liquid hydrocarbon distilled from the crude.

The mercury measurements of the crude during the run were used to determine the kinetics of the reaction. Corrections were made for the amount of naphtha distilled from the crude. The natural log of the ratio of the initial mercury content to the mercury content at the time (corrected for naphtha vaporization) was plotted versus time in a first order rate analysis. Results fell on a straight line for all cases, and the slope gave the first order rate constant. The reaction was found to follow first order kinetics, but on occasion two kinetic species were apparent in the kinetic plots. The majority species (typically about 88%) was a rapidly-reacting species referred to as reactive mercury. A minor species (typically about 12%) was less active and referred to as refractory mercury.

Examples 44 to 68

A series of crudes, condensates and slurries of mercury sulfide reagents were tested according to the procedure in Example 43. Results are shown in Table 10.

In examples 59 and 60 reagent metacinnabar (βHgS) was dispersed in Superla™ white oil. In examples 61 and 64 reagent cinnabar (αHgS) was dispersed in Superla™ white oil. In examples 67 and 68 the solid residue from the crude was dispersed in Superla™.

TABLE 10

| Ex. | Crude ID | T ° C. | Feed Hg pppw | Hg Closure % | Reactive Hg Rate Constant Min-1 | Refractive Hg Rate Constant Min-1 | % Refractory Hg |
|---|---|---|---|---|---|---|---|
| 44 | Crude-1 | 150 | 659 | 95.15 | 0.001379 | | |
| 45 | Crude-1 | 175 | 1,870 | 84.68 | 0.011281 | | |
| 46 | Crude-1 | 175 | 1,106 | 89.67 | 0.017117 | | |
| 47 | Crude-1 | 200 | 1,633 | 94.96 | 0.026871 | 0.004348 | 3.5 |
| 48 | Crude-1 | 225 | 2,061 | 82.86 | 0.046989 | 0.020548 | 7.4 |
| 49 | Crude-1 | 165 | 1,921 | 82.97 | 0.006739 | | |
| 50 | Crude-1 | 196 | 1,825 | 77.02 | 0.037879 | 0.004980 | 5.6 |
| 51 | Crude-1 | 150 | 1,741 | 108.51 | 0.003213 | | |
| 52 | Crude-1 | 175 | 3,233 | 94.50 | 0.005363 | | |
| 53 | Crude-1 | 200 | 3,276 | 92.73 | 0.022106 | 0.008391 | 19.6 |
| 54 | Crude-1 | 225 | 3,203 | 97.87 | 0.055720 | | |
| 55 | Crude-3 | 150 | 496 | 115.84 | 0.002496 | | |
| 56 | Crude-3 | 175 | 604 | 66.26 | 0.020805 | 0.005798 | 11.7 |
| 57 | Crude-3 | 200 | 627 | 91.58 | 0.065734 | 0.018915 | 8.4 |
| 58 | Crude-3 | 225 | 618 | 93.65 | 0.087902 | 0.083873 | 44.6 |
| 59 | β HgS in Superla | 175 | 3,347 | 52.37 | 0.002269 | 0.003303 | |
| 60 | β HgS in Superla | 200 | 2,757 | 90.54 | 0.013611 | | |
| 61 | α HgS in Superla | 250 | 939 | 92.14 | 0.015320 | | |
| 62 | Condensate-2 | 225 | 1,941 | 95.96 | 0.010612 | 0.010241 | 13.3 |
| 63 | Condensate-2 | 175 | 1,771 | 82.76 | 0.055231 | 0.003476 | 5.7 |
| 64 | α HgS in Superla | 275 | 6,454 | 106.87 | 0.033585 | 0.011495 | 45.2 |
| 65 | Condensate-1 | 175 | 2,664 | 62.79 | 0.008675 | | 7.1 |

TABLE 10-continued

| Ex. | Crude ID | T ° C. | Feed Hg pppw | Hg Closure % | Reactive Hg Rate Constant Min-1 | Refractive Hg Rate Constant Min-1 | % Refractory Hg |
|---|---|---|---|---|---|---|---|
| 66 | Crude-2 | 200 | 8,793 | 100.06 | 0.027597 | 0.002535 | 9.2 |
| 67 | Example 26 in Superla | 225 | 2,556 | 85.32 | 0.040714 | 0.008015 | 3.6 |
| 68 | Example 26 in Superla | 225 | 2,696 | 101.06 | 0.015167 | 0.002442 | 11.8 |

The rate constants from all the crudes were analyzed on an Arrhenius plot and the activation energy for the reactive mercury species in thermal decomposition was found to be 13 kcal/mol. There was no significant variation between the crudes. The examples using crude where the refractory mercury species were observed were analyzed and found to have a first order activation energy of 31 kcal/mol.

The mercury in the solid recovered from the crude of Example 21 and tested in examples 67 and 68 showed a rate of decomposition comparable to the rates measured by the crudes. In contrast the two reagent mercury sulfides, αHgS and βHgS, had rates significantly lower than the values found for crudes. Apparently the nanometer scale metacinnabar particles in crude oil, or in solid residues recovered from crude oils, decomposes at a faster rate than the micron-scale reagent mercury sulfides. In comparing the two reagent mercury sulfides, a HgS decomposed at a slower rate than βHgS. This is to be expected since αHgS is more j The nature of the refractory mercury compound could not be identified. It may have been an artifact of the experiment. Metacinnabar (βHgS) is known to convert to the more stable cinnabar (αHgS) during heating. This could have led to the appearance of a more stable species which was termed refractory.

Example 69

In this experiment the thermal decomposition of particulate metacinnabar in crudes was studied in a flow reactor and at 1000 psig to prevent vaporization of the crudes. The crude was passed upflow using an ISCO pump through a three zone furnace in ⅜' tubing. The top and bottom zones had metal rods filling the center and leaving narrow annuli to heat the crude rapidly and to minimize the time spent in this transition. The middle zone had a 8.67 cc wide spot to allow the thermal decomposition to proceed at a uniform temperature. There was no gas fed to the unit, only crude. Once the crude left the top of the reactor, it was cooled and the pressure reduced to atmospheric. Then the crude was passed to a nitrogen stripper which removed the volatile elemental mercury reaction product. The mercury content of the stripped product was measured by Lumex.

The rate constant was calculated from the mercury content of the crude, the mercury content of the product and the LHSV by the following equation.

Rate Constant, min-1=LHSV ln (Crude Hg/Product Hg)/60 where ln means the natural logarithm of the ratio of mercury contents.

Examples 70 to 96

The procedure in example 69 was used on a series of crudes and condensates at various temperatures and pressures. Results are summarized in Table 11.

TABLE 11

| Example No | Crude ID | Crude Hg, ppbw | LHSV | Temp, C. | Stripper Hg, ppbw | 1s Order Rate k, $min^{-1}$ |
|---|---|---|---|---|---|---|
| 70 | Condensate-2 | 2248 | 5 | 175 | 1688 | 0.0239 |
| 71 | Condensate-2 | 2248 | 5 | 225 | 396 | 0.1447 |
| 72 | Condensate-2 | 2248 | 0.5 | 250 | 231 | 0.0190 |
| 73 | Condensate-2 | 2248 | 0.5 | 250 | 164 | 0.0218 |
| 74 | Condensate-2 | 2248 | 1 | 250 | 284 | 0.0345 |
| 75 | Condensate-2 | 2248 | 5 | 250 | 175 | 0.2128 |
| 76 | Condensate-2 | 2248 | 1 | 175 | 980 | 0.0138 |
| 77 | Condensate-2 | 2248 | 0.5 | 175 | 725 | 0.0094 |
| 78 | Condensate-2 | 2248 | 5 | 175 | 1743 | 0.0212 |
| 79 | Crude-1 | 3077 | 1 | 250 | 396 | 0.0342 |
| 80 | Crude-1 | 3077 | 5 | 250 | 481 | 0.1547 |
| 81 | Crude-1 | 3077 | 5 | 175 | 2437 | 0.0194 |
| 82 | Crude-1 | 3077 | 1 | 175 | 1353 | 0.0137 |
| 83 | Crude-1 | 3077 | 5 | 225 | 1163 | 0.0811 |
| 84 | Crude-1 | 3077 | 1 | 225 | 333 | 0.0371 |
| 85 | Crude-1 | 3077 | 0.5 | 225 | 199 | 0.0228 |
| 86 | Crude-1 | 3077 | 0.5 | 250 | 109 | 0.0278 |
| 87 | Crude-2 | 1601 | 5 | 250 | 232 | 0.1608 |
| 88 | Crude-2 | 1601 | 0.5 | 250 | 77 | 0.0253 |
| 89 | Crude-2 | 1601 | 1 | 250 | 109 | 0.0448 |
| 90 | Crude-2 | 1601 | 5 | 225 | 327 | 0.1324 |
| 91 | Crude-2 | 1601 | 1 | 225 | 81 | 0.0497 |
| 92 | Crude-2 | 1601 | 0.5 | 225 | 84 | 0.0246 |
| 93 | Crude-2 | 1601 | 1 | 175 | 415 | 0.0225 |
| 94 | Crude-2 | 1601 | 0.05 | 175 | 250 | 0.0015 |
| 95 | Crude-2 | 1601 | 0.5 | 175 | 447 | 0.0106 |
| 96 | Crude-2 | 1601 | 5 | 175 | 2207 | <0 |

Figure 3:
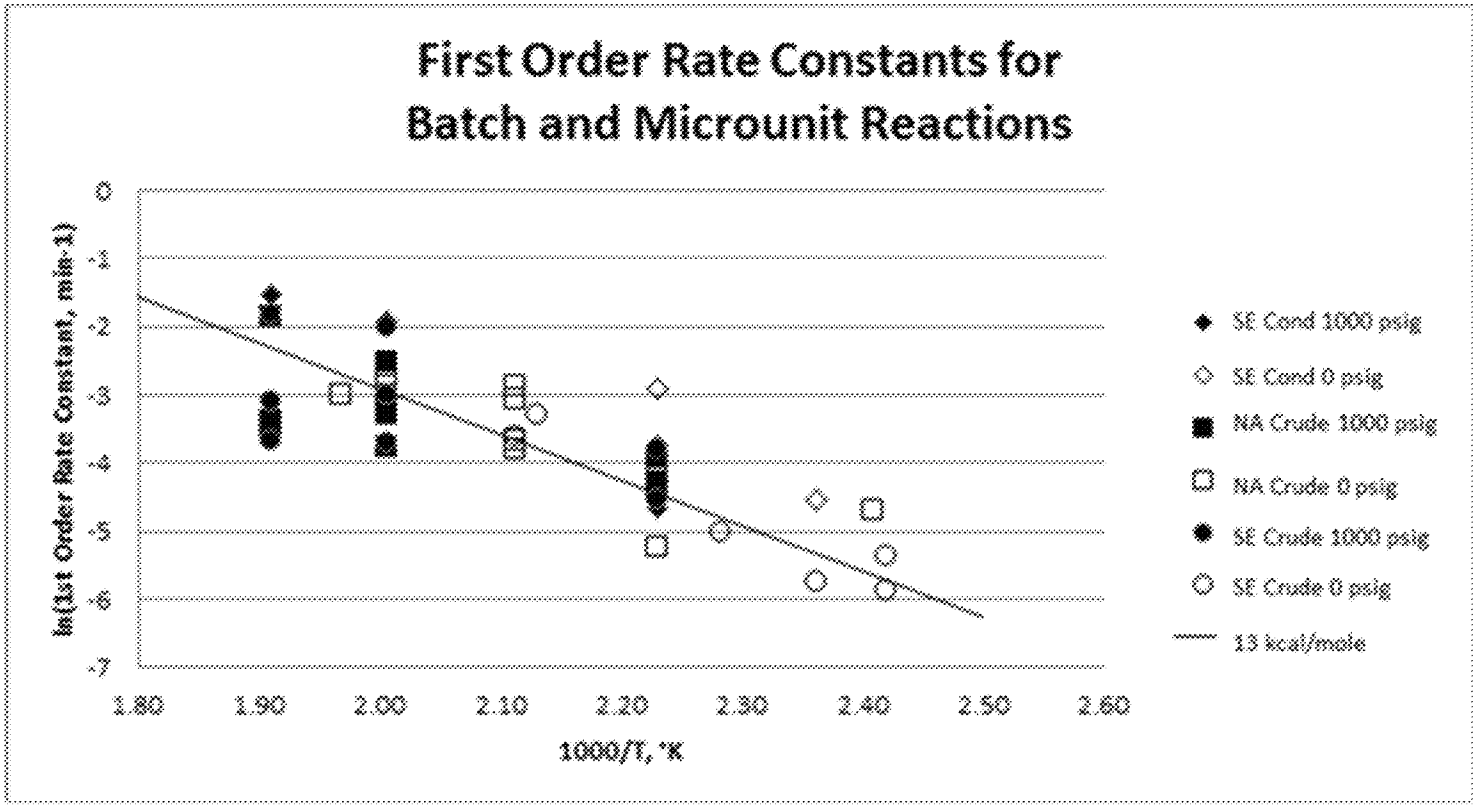
FIG. 3 is a graphical representation of first order rate constants for particulate mercury decomposition reactions.

As shown in FIG. 3 the first order rate constants measured at atmospheric pressure in a glass flask were indistinguishable from the rate constants measured at 1000 psig in a metal reactor. All data was spaced uniformly around the common line found for all crudes.

Example 97

The experimental procedure used in example 61 was modified to study adsorption of the product elemental mercury following the thermal decomposition. A second upflow reactor in a 3 zone furnace was placed after the thermal decomposition reactor. Five cc of 24/42 mesh PURASEC 5158 was place in the reactor with 24/42 mesh Alundum above and below the adsorbent. Operation was at 500 psig.

The tests began with pumping the crude through only the thermal treater. The adsorber was by-passed. Then the flow was directed to the adsorber. The product mercury content was determined by either LUMEX® or CEBAM. The latter was used when the LUMEX® were below 50 ppbw.

Examples 98 to 95

The procedure described in example 97 was used on a crude containing about 9,000 ppbw Hg. Results are summarized in Table 12.

TABLE 12

| Example No | Flow | LHSV | Rx 1 T, ° C. | Rx 2 T, ° F. | Hours on Stream | Delta P, psig | Hg, ppbw | Method |
|---|---|---|---|---|---|---|---|---|
| 98 | 1st Rx | 10 | 150 | | 3 | | | |
| 99 | 1st Rx | 1 | 150 | | 19 | 400 | | |
| 100 | 1st Rx | 1 | 150 | | 20 | | 5470 | Lumex |
| 101 | 1st Rx | 1 | 150 | | 40 | | 1158 | Lumex |
| 102 | 1st Rx | 1 | 250 | | 59 | | 271 | Lumex |
| 103 | Both RX | 1 | 250 | 150 | 82 | | 45 | Lumex |

This example showed that the mercury content of the crude was reduced from its initial very high value of over 9,000 ppbw to less than 50 ppbw. Unfortunately the fixed bed reactor plugged shortly after flow was routed to the adsorber.

Examples 104 to 113

The procedure described in example 97 was used on a sample of a crude containing about 9,000 ppbw Hg except the adsorber was used as 16/24 mesh to reduce the tendency to plug. Results are summarized in Table 13.

TABLE 13

| Example No | Flow | LHSV | Rx 1 T, ° C. | Rx 2 T, ° F. | Hours on Stream | Delta P, psig | Hg, ppbw | Method |
|---|---|---|---|---|---|---|---|---|
| 104 | 1st Rx | 10 | 150 | | 6 | 0 | 3416 | Lumex |
| 105 | 1st Rx | 1 | 250 | | 46 | 0 | 287 | Lumex |
| 106 | Both Rx | 1 | 250 | 150 | 69 | 150 | 835 | Lumex |
| 107 | Both Rx | 1 | 250 | 150 | 90 | 260 | 24 | CEBAM |
| 108 | Both Rx | 1 | 250 | 150 | 178 | 250 | 20 | CEBAM |
| 109 | Both Rx | 1 | 250 | 150 | 225 | 630 | 57 | CEBAM |
| 110 | Both Rx | 1 | 250 | 150 | 241 | 520 | 68 | CEBAM |
| 111 | Both Rx | 1 | 250 | 150 | 269 | 720 | 12 | CEBAM |
| 112 | Both Rx | 1 | 250 | 150 | 289 | 764 | 37 | CEBAM |
| 113 | Both Rx | 1 | 250 | 150 | 380 | 764 | 82 | CEBAM |

These results show that very low values of mercury could be obtained. But as with the previous set of examples, the reactor plugged. Plugging can be avoided by use of many techniques well-known in the industry: guard beds, graded beds, expanded bed, ebullated beds, CSTR reactors etc.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

What is claimed is:

1. A method for removing mercury from a mercury-containing crude oil feed in which greater than 10 wt. % of the mercury contained therein is particulate mercury, the crude oil feed containing 0.1 wt. % or more of $C_4$-hydrocarbons, the method comprising:

degassing the crude oil feed by removing $C_4$-hydrocarbons contained therein, to produce a partially stabilized crude oil having a true vapor pressure in a range of between greater than 9 psig and less than or equal 14 psig, and a first $C_4$-hydrocarbon enriched gaseous stream;

heating the partially stabilized crude oil to a first temperature in a range from 150° C. to 350° C. and at a first pressure, to retain at least 90 vol. % of the $C_4$-hydrocarbons in the liquid phase crude oil;

maintaining the heated partially stabilized crude oil at the first temperature and at the first pressure for 0.1 hours to 10 hours, to convert particulate mercury in the crude oil to elemental mercury;

cooling the heated partially stabilized crude oil to a second temperature in a range from 40° C. to 150° C.;

reducing the pressure of the cooled partially stabilized crude oil to a second pressure lower than the first pressure, and maintaining the cooled partially stabilized crude oil at the second temperature and at the second pressure for 0.1 hours and 10 hours to produce a second $C_4$-hydrocarbon enriched gaseous stream that contains at least a portion of the elemental mercury from the crude oil; and recovering a stabilized crude oil containing a reduced amount of $C_4$-hydrocarbons and at least 10% less mercury than is contained in the crude oil feed.

2. The method of claim 1, further comprising:

passing a stripping gas through the cooled partially stabilized crude oil for removing elemental mercury contained therein; wherein the stripping gas contains C4-hydrocarbons derived from the first C4-hydrocarbon enriched gaseous stream, the second C4-hydrocarbon enriched gaseous stream, or a combination and less than 10 ppbw mercury;

treating a recovered $C_4$-hydrocarbon stream comprising the first $C_4$-hydrocarbons, the second $C_4$-hydrocarbons, or a combination, in a metals recovery unit to produce a mercury-rich stream and a reduced mercury $C_4$-containing stream; and using the reduced mercury $C_4$-containing stream for the stripping gas.

* * * * *